United States Patent [19]

Thompson

[11] 4,264,105

[45] Apr. 28, 1981

[54] SIPHON DREDGE MINING SYSTEM

[76] Inventor: Jerrell K. Thompson, 3833 Ingraham, #A305, San Diego, Calif. 92109

[21] Appl. No.: 51,631

[22] Filed: Jun. 25, 1979

[51] Int. Cl.[3] ..... E02F 7/00

[52] U.S. Cl. ..... 299/9; 37/58; 37/195; 405/74; 209/156

[58] Field of Search ..... 299/8, 9; 405/74; 37/58, 195; 137/140, 147; 209/156, 313

[56] References Cited

U.S. PATENT DOCUMENTS

| | | | |
|---|---|---|---|
| 206,115 | 7/1878 | Jebb | 209/156 |
| 593,430 | 11/1897 | O'Meara | 405/74 |
| 594,041 | 11/1897 | Strong | 299/9 |
| 606,980 | 7/1898 | Poincy | 405/74 |
| 775,255 | 11/1904 | Sewall et al. | 137/140 X |
| 886,390 | 5/1908 | Moninghoff | 137/140 X |
| 1,611,478 | 12/1926 | Massey | 37/58 |
| 2,688,461 | 9/1954 | Simpson | 137/147 X |

*Primary Examiner*—Ernest R. Purser
*Attorney, Agent, or Firm*—Brown & Martin

[57] ABSTRACT

A dredging system operates entirely by siphon action and includes a completely sealed conduit system having the intake end disposed upstream or at an upper level from the outlet end which is disposed sufficiently below the inlet end to maintain a flow of water once started. A pump and bypass system is provided for starting the system in operation with the pump bypassed once the system begins this operation. The system is designed to operate continuously without the need for auxiliary power at dams and reservoirs and the like.

8 Claims, 3 Drawing Figures

SIPHON DREDGE MINING SYSTEM

BACKGROUND OF THE INVENTION

The present invention relates to dredging and mining operations and pertains particularly to a novel self powered dredging system.

The use of dredges for lifting and removing materials from the bottom of bodies of water, such as lakes, streams, rivers, the ocean and the like have been and are well known. Such systems generally employ a high velocity pumping system which draws a high velocity flow of water through an intake end of a conduit system and discharges it along with the collected debris into barges or the like.

Such systems are used for mining to remove materials and the like from streams and lake beds and other bodies of water and for removing the valuable minerals and the like from the debris raised from the floor of the body of water.

Dredging systems are also quite frequently used simply to remove accumulation of materials from waterways to free the waterway for passage of ships and the like. Such dredges are also used to remove silt and other accumulated debris from the bottom of lakes and the like, to maintain the capacity of the reservoir. The materials dredged from the bottom of lakes and the like may include sand and gravel, which has commercial value totally apart from any minerals or the like, that may be present. The dredging operation can commercialize the sand and gravel, and at least partially offset the cost thereof by such technique.

The continuous dredging of lakes and the like constitutes an enormous problem in that it requires a considerable amount of energy to continuously operate the pumps and the like of the dredging system.

The following U.S. Patents are exemplary of the dredging art:

U.S. Pat. No. 75,004 issued Mar. 3, 1968 to Duvall.

U.S. Pat. No. 1,551,657 issued Sept. 1, 1925 to Goetriz.

U.S. Pat. No. 1,611,478 issued Dec. 21, 1926 to Massey.

U.S. Pat. No. 2,754,763 issued July 17, 1956 to Hoser.

U.S. Pat. No. 3,263,615 issued Aug. 2, 1966 to Hoser.

U.S. Pat. No. 3,448,691 issued June 10, 1969 to Frazier.

U.S. Pat. No. 3,681,862 issued Aug. 8, 1972 to DeKoning.

U.S. Pat. No. 3,772,805 issued Nov. 20, 1973 to DeKoning.

U.S. Pat. No. 3,950,246 issued Apr. 3, 1976 to Kosifch.

U.S. Pat. No. 2,096,595 issued Oct. 19, 1937 to Sanford.

The above mentioned Massey patent discloses a hydraulic dredging device wherein a siphon return pipe is utilized for assisting the lift of the water through the system. He also recognizes and discloses the use of a screen conduit for separating finer materials, such as sand from gravel. The remaining patents are of interest only.

These systems all disclose and utilize a pump for continuous operation powered by a motor or internal combustion engine.

It is desirable that a dredging system be available which reduces the dependence on the use of motors and engines for powering the systems.

SUMMARY AND OBJECT OF THE INVENTION

It is accordingly the primary object of the present invention to overcome the above problems of the prior art.

Another object of the present invention is to provide a simple and inexpensive dredging system that is self operated by siphon action.

In accordance with the primary aspect of the present invention, a dredging system includes conduit means having an intake and an outlet disposed at different levels within the outlet sufficiently below the inlet to maintain a continuous siphon action once started. Another aspect of the invention includes a heavy mineral recovery system.

BRIEF DESCRIPTION OF THE DRAWING

The above and other objects and advantages of the invention will become apparent from the following description when read in conjunction with the drawings, wherein.

DETAILED DESCRIPTION OF A PREFERRED EMBODIMENT

Figure 1:
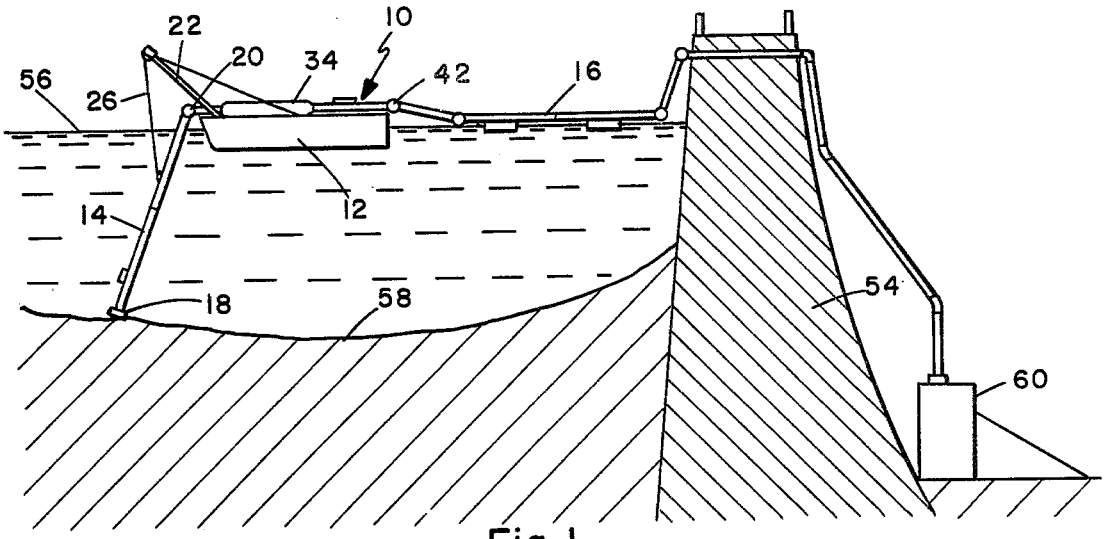
FIG. 1 illustrates the complete siphon dredge system in operation.

Turning to the drawing, there is illustrated in FIG. 1 a system in accordance with the preferred embodiment of the invention. The system designated generally by the numeral 10 includes a barge or other support structure 12 supporting an intake pipe or conduit 14 which is connected by a suitable system that is fluid tight to outlet conduit 16. A key feature of the invention is that the siphon pipe, or at least the major portion, and the outlet of the siphon pipe 16 is disposed at a substantial distance below the suction pipe 14 and particularly the inlet thereof. With this arrangement and the fact that the conduit system is water tight or sealed to be air tight, the entire system becomes a giant siphon and operates as such.

The outlet end of the siphon pipe 16 is sufficiently below the inlet end of the intake of suction pipe 14 that a substantial head is developed in the system to maintain a sufficient velocity and flow of the water through the system to function and maintain the dredging action. Such a system as contemplated herein is ideal for continuous operation at lakes and dams and for rivers, and other streams at high elevation such that the outlet of the dredge system can be disposed sufficiently below the stream bed to establish the necessary head.

Looking specifically at the illustrated embodiment as seen in FIG. 1, the major portion of the conduit means is supported for manipulation on the barge 12. The intake pipe of section pipe 14 includes an inlet in 18 and is joined by a sealed swivel joint 20 conduit portion disposed on the barge 12. The support and manipulation means include a crane or boom 22 and a hoist or winch assembly 24 including a cable or the like 26 connected to the suction pipe. Manipulation of the lower end 18 of the suction pipe can be accomplished by any number of approaches, such as movement of the barge itself or simply moving the dredging suction or inlet pipe 14.

Figure 2:
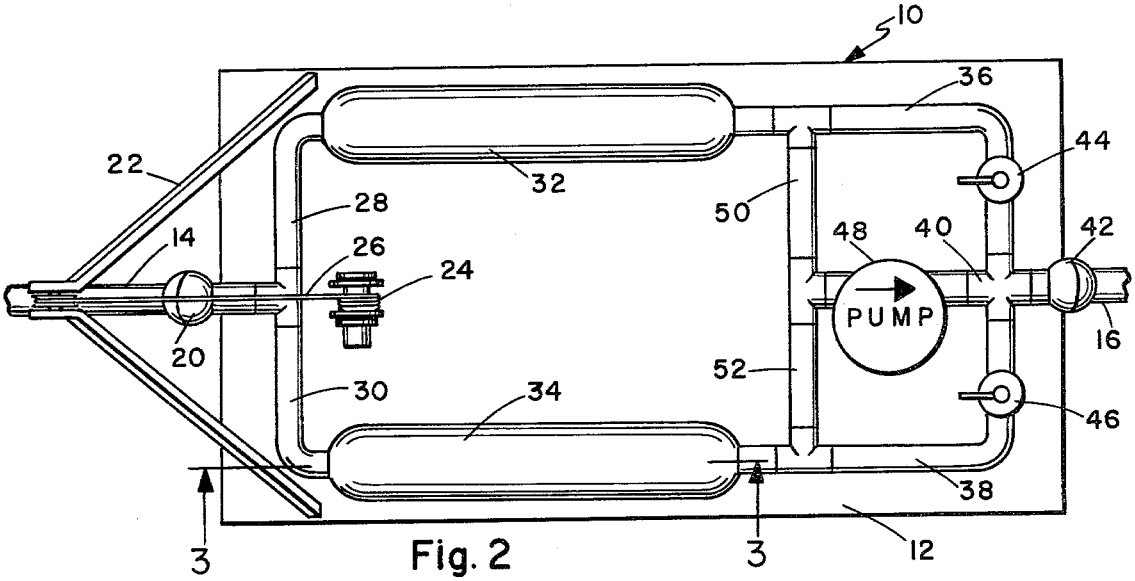
FIG. 2 is an enlarged top plan view of the barge carrying the siphon dredge apparatus.

The conduit system itself is constructed to be air tight, and as illustrated in FIG. 2 includes a pair of bypass lines 28 and 30 flowing through a pair of separators 32 and 34 for separating finer high density materials such as gold or the like from the dredge material. The separator can be modified and adapted for particular application to be described.

The flow of water and material passing through the separator 32 and 34 during normal operation passes along branch lines 36 and 38 to four way juncture 40 and suitable swivel joint 42 to the siphon or outlet line 16. The outlet or siphon ine 16 may be made up of a plurality of joints of pipe or conduit connected together in any suitable manner.

A pair of valves 44 and 46 controls the bypass conduits 36 and 38 for bypassing a pump 48 which is connected by branch lines 50 and 52 into the main line from the separators 32 and 34.

The system is initially started by means of the pump 48 or other suitable approach by starting a flow of water through the conduit means. This is presently started by raising the lower end of the inlet pipe 14 such that only water will flow into the conduit upon the initial starting of the system. The pump 48 is thus started and is powered by suitable motor or engine (not specifically shown) until a flow of water is established in the line sufficient to continue operation. The valves 44 and 46 are then opened to establish direct flow of water through the bypass line 36 and 38 by siphon action. It should be appreciated that the outlet of the system at the lower end of the siphon or outlet pipe 16 is considerably below the inlet at 18, sufficient to establish and maintain sufficient velocity of, and force of flow to maintain dredging operation once begun. After the pump 48 has been bypassed the intake end 18 of suction pipe 14 can then be manipulated into position to lift debris and the like from the floor of the stream or body of water.

In the illustrated embodiment the installation is at a man made lake having a dam structure 54 which dams up a stream or the like creating a body of water 56 having a bottom 58.

As in most lakes or dams which dam up a stream such as a river or the like, continuous flow of water into the reservoir deposits sand and gravel and other debris into the bottom of the reservoir. This eventually fills the reservoir and displaces the capacity of the reservoir to hold water if dredging operation is not established at least periodically. The present system is contemplated as a permanent installation and continuously operating system. The system can be operated to remove the accumulation of debris from the bottom of the reservoir and the debris may be simply discarded or may be salvaged. Recovery of materials can be carried out such as by running the material through separators to separate any accumulation of gold or similar heavy metals and the like, and running the debris into a separation and recovery plant 60 which separates and recovers sand and gravel and the like. With such an installation the operation once begun, can continue indefinitely without the necessity for shut down because of fuel or other power failure.

The installation can be made at any suitable reservoir or stream having the terrain for the installation such that the outlet can be sufficiently below the inlet to establish sufficient power or pressure differential to maintain the sufficient volume and flow or velocities of water to establish and maintain the dredging action. Such dredging systems can be used for the primary purpose of maintaining the reservoir in maximum capacity or for other purposes such as the recovery of sand and gravel from such reservoirs or streams, or for the primary purpose of recovery of precious metals and minerals or any combination of these.

The installation can be such as to be self starting without the necessity of a pump such as for example where employed in a river bed or the like having a fairly deep drop through waterfalls or rapids and the like, such that the conduit can be laid below water surface level and flow established therein. Other installations at dams or the like can be self starting wherein the conduit is laid within a running spillway such that the flow can be established by normal flow of water. With such installations, the necessity for the pump even for starting, can be eliminated.

Figure 3:
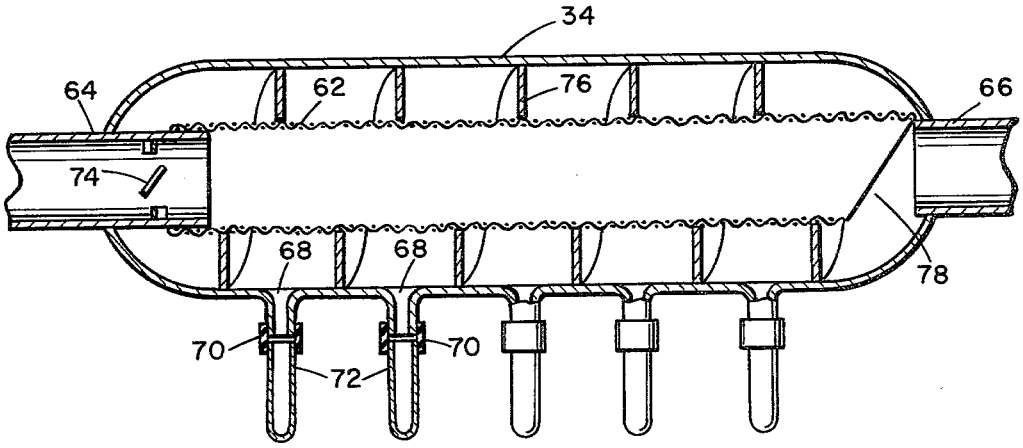
FIG. 3 is an enlarged sectional view taken on line 3—3 of FIG. 2.

Turning now to FIG. 3, the separators of the present systems consist of an enlarged housing preferably of a generally cylindrical configuration, having a perforated or fine screen tube 62 extending between the inlet conduit 64 and an outlet tube or conduit 66. The ratio or size of the housing and the inlet and outlet is established to provide sufficient reduction in velocity of the flow therethrough to permit heavier materials such as gold for example, to separate and drop from the fluid and accumulate within the housing 34. Preferably suitable means are provided such as a plurality of openings 68 having a socket configuration for receiving a plurality of vials or containers 72 which fit within the socket 70. These containers are preferably transparant for visually monitoring the material therein. With such an arrangement the separation of gold for example can usually be accomplished with the device in operation. The gold flakes or the like will separate from the fluid within the chamber and fall to the bottom of the housing, accumulating in the vials 72. These may be removed during the operation of the device without interruption of the operation. Should a single vial be removed, the intake of air through the inlet or opening would be insufficient to interrupt the system.

The separator is preferably shaped substantially as illustrated to facilitate the separation of particles from the water. The enlarged shell preferably enlarges gradually out to its outer diameter and similarly decreases at the outlet. Means in the form of vanes 74 at the inlet and spiral vanes 76 are provided to cause the water to swirl outward as it passes through the separator to cause finer materials to pass through the screen. The spiral or helical rib 76 extends along the outside diameter of the tubular screen 62.

The openings 68 are preferably formed at, or with a substantially frusto-conical transition or collection cavity to aid in funneling material into vials 72. The screen 62 is provided with an opening 78 at the outlet to permit sand which passes through the screen into the outer shell to pass into outlet pipe 66. It has been found that proper adjustment of the water velocity and swirl through the separator results in the accumulation of gold in vials 72 with very little accumulation of sand therein. The sand is carried by the action of the water past the collector.

The separator and other components of the system can be fabricated of any suitable material such as steel or a good grade of plastic. The separator 34 can be either transparent or have windows therein for permitting monitoring of the action within the separator.

The present system can be installed at existing dams and reservoirs or can be incorporated therein during construction of the dam. The conduit can either pass over or through the dam structure. Preferably, the conduit is kept low to reduce the amount of lift required to pass the material and water through it.

While I have described my invention by means of specific embodiments it is to be understood that numerous changes and modifications may be made therein without departing from the spirit and scope of the invention as defined in the appended claims.

I claim:

1. A mineral recovery and reservoir maintenance system comprising in combination:

a reservoir containing a body of water;

a recovery plant located adjacent to and below the bottom of said reservoir;

a floating support structure supported on and moveable about said body of water;

a siphon dredging system for removing material from the bottom of said reservoir and depositing it at the recovery plant;

said dredging system including conduit means support on said floating support structure and having an inlet end defined by a suction pipe, a discharge end defined by a siphon pipe having the discharge end disposed in a position at said recovery plant lower than said inlet end for maintaining a siphon action after a flow of water has been initiated in said conduit; and means for starting of water in said conduit means for initiating operation of the said dredging system.

2. The siphon dredge of claim 1 wherein said floating support structure comprises a floating barge and includes a boom and hoist mounted on said barge for manipulating the suction pipe to multiple positions on the bottom of said reservoir.

3. The siphon dredge of claim 1 wherein:

said means for initiating a flow of water in said conduit means comprises a pump, and bypassing means for bypassing said pump when flow of water has been initiated, and maintaining said flow for performing a dredging operation.

4. The siphon dredge of claim 3 including mineral separating means on said barge for separating fine particles from the dredged material prior to delivery of the dredged material to the recovery plant.

5. The siphon dredge system of claim 4 wherein said reservoir is defined by a man-made dam and said recovery plant is located below said dam.

6. The siphon dredge of claim 4 wherein said separating means comprises a cylindrical chamber disposed in said conduit means and a tubular screen concentrically mounted in said chamber; and a plurality of removable containers in open communication with the interior of said chamber.

7. The siphon dredging system of claim 6 wherein said tubular screen is substantially the same diameter as said conduit means;

said cylindrical chamber is larger than said tubular screen; and further including means for inducing water to swirl through the tubular screen and cylindrical chamber.

8. The siphon dredging system of claim 7 wherein said separating means comprises a pair of cylindrical chambers disposed in parallel in said system.

* * * * *